US006715759B2

(12) United States Patent
Gladders et al.

(10) Patent No.: US 6,715,759 B2
(45) Date of Patent: Apr. 6, 2004

(54) CLAY PIGEONS

(75) Inventors: Stanley Briers Gladders, Orston (GB); Royston Esler Starkey, Bromsgrove (GB)

(73) Assignee: Gurney Slade Lime & Stone Company, Limited (GB)

( * ) Notice: Subject to any disclaimer, the term of this patent is extended or adjusted under 35 U.S.C. 154(b) by 0 days.

(21) Appl. No.: 10/149,511

(22) PCT Filed: Dec. 11, 2000

(86) PCT No.: PCT/GB00/04748

§ 371 (c)(1),
(2), (4) Date: Sep. 9, 2002

(87) PCT Pub. No.: WO01/42731

PCT Pub. Date: Jun. 14, 2001

(65) Prior Publication Data

US 2003/0050391 A1 Mar. 13, 2003

(30) Foreign Application Priority Data

Dec. 10, 1999 (GB) ..... 9929359

(51) Int. Cl.[7] ..... F41J 9/16
(52) U.S. Cl. ..... 273/362
(58) Field of Search ..... 273/362–365

(56) References Cited

U.S. PATENT DOCUMENTS

| | | | | | |
|---|---|---|---|---|---|
| 3,469,411 | A | * | 9/1969 | Silva | 273/362 |
| 4,124,550 | A | | 11/1978 | Kobayashi et al. | 260/23.3 |
| 4,271,118 | A | * | 6/1981 | Schreiner-Hansen | 273/363 |
| 4,623,150 | A | | 11/1986 | Moehlman et al. | 273/362 |
| 5,387,380 | A | | 2/1995 | Cima et al. | 264/69 |

FOREIGN PATENT DOCUMENTS

| | | |
|---|---|---|
| WO | WO 95/07245 | 3/1995 |
| WO | WO 98/51989 | 11/1998 |

* cited by examiner

*Primary Examiner*—Mark S. Graham
(74) *Attorney, Agent, or Firm*—Young & Basile, P.C.

(57) ABSTRACT

A method of making clay pigeons is disclosed involving the step of compacting a dry powder comprising an inorganic filler comprising more than 50% by weight calcium carbonate and a binder. Also disclosed is a dry pressed pitchless clay pigeon.

3 Claims, No Drawings

CLAY PIGEONS

FIELD OF THE INVENTION

This invention relates to clay pigeons.

BACKGROUND OF THE INVENTION

In the sport of clay pigeon shooting targets (known as "clay pigeons" or "clays") are flung into the air by a launching device (known as a "trap") and a participant in the sport attempts to shoot the moving target using a shotgun. On impact of shot, the target is intended to break up.

Clay pigeons are conventionally manufactured using a hot moulding process in which milled limestone and hot pitch are moulded together, the pitch comprising approximately 20–40% by weight. Handling hot pitch has health and safety implications for workers making the clay pigeons.

One problem with competitive clay pigeon shooting is that sometimes an impact from a single shot will not be sufficient to cause the target to break up fully and this can lead to dispute over whether a clay pigeon has been hit or not. Ideally a clay pigeon should disintegrate even if hit by just one shot. This ideal is not normally met. At the same time the clay pigeon should be strong enough not to disintegrate in transport or when flung from the trap.

A further problem is the quantity of material that is left after a major clay pigeon shooting event. Every clay pigeon that goes up comes down to ground somewhere, either intact or in pieces. Approximately 350 million clay pigeons are sold per annum in the United Kingdom alone, and this represents a lot of material strewn on the ground (equivalent to approximately 3,500 tonnes per annum). The fact that the clay pigeons, if not hit or if only glancingly hit, leave large sized debris means that the material of the clay pigeons resists degradation for some time. The pitch present in the clay pigeons further impedes degradation.

Additionally, pitch tars have been classified as potential or actual carcinogens in some jurisdictions and there is a risk of contaminating ground waters with run off where there is a large quantity of clay pigeon debris, for example at shooting grounds.

U.S. Pat. No. 5649807 disclosed the manufacture of clay pigeons comprising at least 50% by weight clay, and 5–50% calcium containing additive (which could be limestone powder) which reduces the drying shrinkage of the (wet) clay. A plasticity-improving component such as a lignosulphonate could also be used. Clay pigeons are made from this mixture by pressing the mixture in a mould and removing them while still in a plastic (wet) state. Because the moulded clay pigeon is still wet careful handling to remove the clay pigeon from the mould is required. Even so such a process will cause problems in the reproducibility of the shape, dimensions, weight, and texture of the clay pigeons produced, with a consequent variability in their flying characteristics. This is not desirable.

The present invention aims to overcome the problem of handling plastic (wet) clay pigeons by forming the clay pigeons by compaction from a dry powder.

FR-A-2575818 discloses a clay pigeon formed by drying pressing from a clay, and incorporating a stabiliser (rapid setting cement or lignosulphite). The function of the lignosulphite is to provide mechanical stability to the pressed pigeon.

The applicants have found that clay pigeons produced with clay and such a binder are too fragile.

The present invention aims to overcome the problem of fragility of clay pigeons by providing an improved binding system.

GB-A-2337003 discloses a clay pigeon comprising sulphur, a filler, and a sulphur modifier which may be a lignin sulphonate. The lignin sulphonate modifies the behaviour of the sulphur. Such clay pigeons are expensive to form however, requiring the melting of the sulphur, dwelling at temperature, and subsequent casting.

The present invention aims to overcome the problem of high cost forming routes by using dry pressing powders.

SUMMARY OF THE INVENTION

Accordingly the present invention provides a method of making clay pigeons by the step of compacting a dry powder comprising an inorganic filler and a binder, the inorganic filler comprising greater than 50% by weight calcium carbonate.

The inorganic filler may comprise more than 60%, 70%, or 80% by weight calcium carbonate if desired.

In the context of this application the term "dry" need not mean totally free of water but does mean comprising less than 10% by weight of water based on the amount of the inorganic powder.

The inorganic filler may comprise clay.

The binder may comprise a lignosulphonate compound.

Lignosulphonates are materials obtainable from wood and are available from both hard and soft woods. Lignosulphonates may be modified and include altered cations. For the present invention all lignosulphonates may be used, modified or unmodified, and may include any suitable cation or cations, for example calcium, magnesium, ammonium and sodium.

The clay pigeon may be made by a process in which the inorganic filler and binder are mixed as a slip and spray dried to form the dry powder.

DETAILED DESCRIPTION OF THE PREFERRED EMBODIMENT

Accordingly the present invention provides a method of making clay pigeons by the step of compacting a dry powder comprising an inorganic filler and a binder, the inorganic filler comprising greater than 50% by weight calcium carbonate.

The inorganic filler may comprise more than 60%, 70%, or 80% by weight calcium carbonate if desired.

In the context of this application the term "dry" need not mean totally free of water but does mean comprising less than 10% by weight of water based on the amount of the inorganic powder.

The inorganic filler may comprise clay.

The binder may comprise a lignosulphonate compound.

Lignosulphonates are materials obtainable from wood and are available from both hard and soft woods. Lignosulphonates may be modified and include altered cations. For the present invention all lignosulphonates may be used, modified or unmodified, and may include any suitable cation or cations, for example calcium, magnesium, ammonium and sodium.

The clay pigeon may be made by a process in which the inorganic filler and binder are mixed as a slip and spray dried to form the dry powder.

The invention is illustrated by way of example in the following.

Calcium carbonate, clay, and lignosulphonate and a plasticiser were mixed with sufficient water to form a slip but not so much as to require excessive energy costs in drying and and ball milled for four hours.

The calcium carbonate (supplied by Omya UK, Dorking, Surrey, England [similar grades available from Gurney Slade Lime and Stone Company Limited, Bath, England]) was 98.4% pure with a specific gravity of 2.7 and a particle size fine enough that less than 0.1% was retained on a 125 micron sieve.

The clay (supplied by ECC International Ltd. Cornwall England) had the composition (in wt %):

| | |
|---|---|
| $SiO_2$ | 54% |
| $Fe_3O_4$ | 1.4% |
| $TiO_2$ | 1.2% |
| $K_2O$ | 3.1% |
| $Al_2O_3$ | 40.3% |
| Surface Area (BET) | 41 |

The lignosulphonate used was a modified softwood lignosulphonate with calcium ions (available from Borregaard UK Ltd. of Warrington, Cheshire, England).

The plasticiser was a polyglycol having a molecular weight of 1500 (available from Hoechst as product number IOPF205605).

A typical recipe by weight for the slip is:

| | |
|---|---|
| Water | 37.4% |
| Calcium carbonate | 45% |
| Clay | 11% |
| Lignosulphonate | 5.5% |
| Plasticiser | 1.1% |

Which corresponds to dry weight proportions of:

| | |
|---|---|
| Calcium carbonate | 71.88% |
| Clay | 17.57% |
| Lignosulphonate | 8.79% |
| Plasticiser | 1.76% |

The slip was spray dried at an inlet temperature of 395° C. and outlet temperature of 110° C. The resultant powder was free flowing and had the properties:

| | |
|---|---|
| Moisture content | 0.76% |
| Bulk Density | 95.9 gm/cc |
| Mean particle size | 9 microns |

It will be clear to the reader skilled in the art that other processes can be used to produce a free flowing uniform powder of this nature, e.g. vibromilling to mix and disperse the ingredients and freeze drying to remove the water. The invention is not limited to ball milling and spray drying.

The powder was pressed in a mechanical press at room temperature and at a pressure of 120 MPa. The powder can be pressed both mechanically or hydraulically by die pressing or isostatic pressing or any other route that applies a sufficient bonding pressure.

The lignosulphonate binder reacts with the calcium carbonate to form a binding system. The precise mechanism is not understood, but a good approximation can be deduced by reference to known lignin properties and their effect on various substrates. Lignosulphonates have a strong affinity for certain mineral substrates like limestone and attach themselves by hydrogen bonding to the particle surfaces. An acqueous limestone slurry dispersed with a polyelectrolyte like calcium lignosulphonate does not flocculate due to two complementary mechanisms:

(i) Electrostatic repulsive forces generated by the presence of an electrical double layer at the particle/solution interface.

(ii) Steric repulsion, arising from the apparent expansion of the particle due to the absorbed dispersant.

If the water is then removed from such a system (e.g. by spray drying) the lignin remains firmly bonded to the mineral surfaces, in a thin uniform layer. The lignin however is no longer acting as a polyelectrolyte dispersant, and adjacent lignin covered surfaces will have a strong affinity for each other. The observed effect of which is an increase in the minerals packing density.

It has also been suggested that since the previous deflocculating effect causes the mineral to become very finely divided, that these more discrete particles are retained when the mineral is recrystallised. (Though clearly the recrystallisation conditions will have a pronounced effect on this phenomenon.) Subsequent application of a compaction force allows the lignin to form hard agglomerates due to an inactive film bonding system. Other binders that achieve the same end result can of course be used.

The resultant clay pigeon could be packed (or used) immediately on removal from the tool die. Pressing by this route produces clay pigeons having an extremely high uniformity of shape, dimensions, weight, and texture which therefore have relatively uniform flight characteristics. The following table compares dimensions of a conventional "mini" clay pigeon (nominal diameter 60 mm and nominal weight 35 grams) with ones made to the invention. It can be seen that a much more uniform product results.

| | Normal | To invention | Invention as percentage of normal |
|---|---|---|---|
| Diameter (mm) | | | |
| Mean | 59.92 | 60.59 | 77.78% |
| Standard Deviation | 0.054 | 0.042 | |
| Rim thickness (mm) | | | |
| Mean | 11.15 | 11.11 | 23.89% |
| Standard Deviation | 0.18 | 0.043 | |
| Centre thickness (mm) | | | |
| Mean | 2.66 | 1.78 | 36.67% |
| Standard Deviation | 0.15 | 0.055 | |
| Out of round (mm) | | | |
| Mean | 0.09 | 0.052 | 57.78% |
| Standard Deviation | 0.039 | 0.037 | |
| Mass (g) | | | |
| Mean | 33.86 | 35.99 | 46.48% |
| Standard Deviation | 0.71 | 0.33 | |

In contrast to forming from wet materials, there is no shrinkage on drying which could lead to warping and dimensional changes. Rather, the clay pigeons are produced to finished shape and size in one step.

The clay pigeons so produced burst rather than break up on impact by a shot, disintegrating completely. By bursting the clay pigeons scatter their remains thinly over the ground so improving incorporation into the ground.

The lignosulphonate binder degrades in water and under biological action to disappear, so allowing the powder remains of the clay pigeon to be incorporated into the ground.

The polyglcol plasticiser will biodegrade over time and although having some degree of toxicity at high concentrations, is unlikely to reach toxic limits in the field.

The range of inorganic fillers and binders that may be used is large and the proportions to be used are a matter of experiment for any given combination of fillers and binders.

What is claimed is:

1. A method of making clay pigeons by the step of compacting a dry powder comprising an inorganic filler and a binder, the inorganic filler comprising greater than 50% by weight calcium carbonate particles characterised in that the binder comprises a lignosulphonate compound, and in that prior to compaction at room temperature the inorganic filler and lignosulphonate compound are mixed as an acqueous slurry and spray dried to form a free flowing, uniform powder in which lignin is bonded to the surface of the calcium carbonate particles in a uniform layer, so that adjacent lignin covered surfaces have a strong affinity for each other.

2. A method of making clay pigeons as claimed in claim 1, in which the inorganic filler also comprises clay.

3. A method of making clay pigeons as claimed in claim 1 in which a plasticiser forms part of the powder.

* * * * *